US008310323B2

(12) United States Patent
Niimi

(10) Patent No.: US 8,310,323 B2
(45) Date of Patent: Nov. 13, 2012

(54) ELECTROMAGNETIC SWITCH FOR STARTER

(75) Inventor: Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 127 days.

(21) Appl. No.: 12/822,312

(22) Filed: Jun. 24, 2010

(65) Prior Publication Data

US 2010/0330850 A1 Dec. 30, 2010

(30) Foreign Application Priority Data

Jun. 25, 2009 (JP) ..... 2009-151240

(51) Int. Cl.
*H01H 63/02* (2006.01)
*H01H 67/02* (2006.01)

(52) U.S. Cl. ..... 335/133; 335/131

(58) Field of Classification Search ..... 335/126, 335/127, 131–133, 196–200; 290/38 R–38 E, 290/48; 200/275–279
See application file for complete search history.

(56) References Cited

U.S. PATENT DOCUMENTS 2,018,073 A * 10/1935 Laise ..... 200/268
6,404,310 B1 * 6/2002 Ando et al. ..... 335/133

FOREIGN PATENT DOCUMENTS

JP A-2004-319128 11/2004

* cited by examiner

*Primary Examiner* — Ramon Barrera
(74) *Attorney, Agent, or Firm* — Oliff & Berridge, PLC

(57) ABSTRACT

Terminal bolts are inserted in the bottom of contact cover through collars. C-rings are fitted into U-shaped grooves formed in the terminal bolts and constitute locking parts. Circular notch parts are formed on the innersurface at the contact chamber side of the collars and the notch parts are engaged with the C-ring whereby ring terminals receive pressing force of nuts tightened on the terminal bolts. Accordingly, spaces are created at places being closer to the contact chamber side than the C ring side of the terminal bolts are, by interposing O-rings with large thickness in the spaces in elastically compressed states, whereby an airtightness of the contact chamber can be secured without expanding an outer diameter of the contact cover. Thus, an electromagnetic switch can adopt sealing members with sufficient thickness without expanding an outer diameter of the contact cover.

10 Claims, 4 Drawing Sheets

ELECTROMAGNETIC SWITCH FOR STARTER

CROSS REFERENCES TO RELATED APPLICATION

The present application relates to and incorporates by reference Japanese Patent application No. 2009-151240 filed on Jun. 25, 2009.

BACKGROUND OF THE INVENTION

1. Field of the Invention

The present invention relates to an electromagnetic switch which turns on/off a conduction (energizing) current of a starter motor.

2. Description of the Related Art

Conventionally, an electromagnetic switch which turns on/off a conduction (energizing) current fed to a starter motor which starts an engine is widely known.

When a movable contact is driven by magnetomotive force which an exciting coil generates by being energized, so as to contact a pair of fixed contacts which is placed opposite the movable contacts, the pair of fixed contacts are short-circuited with each other. This makes the electromagnetic switch close an electric circuit. The exciting coil is conducted with a switch terminal which is energized in response to ON operation of an ignition switch, and the pair of fixed contacts are conducted respectively with a battery terminal and a motor terminal, both of them are formed protrusively outward at a contact cover fitted into a yoke of the exciting coil. A battery cable is connected to the battery terminal, and a motor lead is connected to the motor terminal. The electric circuit is closed by the operation of the electromagnetic switch, thereby a motor generates torque in response to power feeding from a battery. The torque is slowed down with an epicycle reduction gear for example, and is transmitted to a pinion gear. An engine crankshaft is rotated by engaging the pinion gear with a ring gear provided in the engine crankshaft, and an engine starts up.

In an electromagnetic switch disclosed in a Japanese Patent Application Laid-Open Publication No. 2004-319128, as shown in FIG. 1, collars 101, 102 are insert-molded at the bottom of a contact cover 100, and in each hollow part of the collars 101, 102, a battery terminal bolt 103 and a motor terminal bolt 104 are inserted respectively. The battery terminal bolt 103 and the motor terminal bolt 104 are bolt-like members having respective heads 103*a*, 104*a* in which fixed contacts 105, 105 are formed, and respective feet 103*b*, 104*b* in which male screws are formed on the surfaces. The collar 101 (102) extends from the inside of the contact cover 100 to the outside. One end of the collar 101 (102) abuts against a back of a side facing the fixed contact 105 of the head 103*a* (104*a*) inside the contact cover 100, and the other end of the collar 101 (102) abuts against a fixed washer 106 outside the contact cover 100. Ring terminals 107*a*, 108*a* are formed at a top of a battery cable 107 and a motor lead 108 respectively. The ring terminals 107*a*, 108*a* are respectively interposed between the fixed washers 106,106 and nuts 109,109 screwed on the male screws formed in the feet 103*b*, 104*b* of the terminal bolts 103, 104, then the ring terminals 107*a*, 108*a* are tightened.

By the way, in the case where the electromagnetic switch is used under a severe environment where excessive vibration from the engine is directly received, the nut 109 may loosen by excessive vibration. Therefore, it is necessary to prevent the battery cable 107 and/or the motor lead 108 separate from the respective collars 101,102. Then, if the battery terminal bolt 103 and the motor terminal bolt 104 are formed through the collars 101, 102 as the above composition, a tightening loads of the nuts 109,109 are received in the axial direction of the collars 101, 102 having high strength. Consequently, the nut 109 can be firmly tightened. In addition, looseness of the nut 109 by vibration or aging can be controlled since the creep tolerance of metal under compressive load is excellent compared with resin.

However, in the above electromagnetic switch, other than the above composition, an O-ring is fitted on an outer circumference of each head 103*a*, 104*a* of the battery terminal bolt 103 and the motor terminal bolt 104 in order to secure the airtightness in the contact cover 100. In order to improve sealability for airtightness, an O-ring with sufficient thickness should be adopted, compressed strongly, and as a result, largely elastically deformed. However, in such composition, increase in the thickness of the O-ring may require larger outer diameter of the contact cover 100. In order to avoid the enlargement of the outer diameter of the contact cover 100, thin sealing member should be used.

SUMMARY OF THE INVENTION

The present invention has been made in view of such conventional problems, and thus, it is an object of the present invention to provide an electromagnetic switch which can secure the sealing member with sufficient thickness without expanding the outer diameter of a contact cover.

In order to achieve the aforementioned object, the present invention provides an electromagnetic switch including an exciting coil which generates magnetomotive force by being energized, a movable contact driven by the magnetomotive force of the exciting coil, a pair of fixed contacts placed opposite the movable contact, a contact cover of a shape having a contact chamber provided therein and containing the movable contact and the pair of fixed contacts, tubular members fitted into respective terminal holes formed in the bottom of the contact cover, terminal bolts inserted in respective tubular members and conducted with the pair of fixed contacts respectively, sealing members sealing respective gaps between the terminal holes and the terminal bolts, and tightening members screwed on the respective male screws of the terminal bolts, so as to fix ring terminals to the terminal bolts respectively. wherein the terminal bolts have locking parts projected in the direction of outer diameter, one end at the contact chamber side of the tubular members abut against the locking parts and the sealing members are engaged closer to the contact chamber side than the locking parts of the terminal bolts are.

Since ends at the fixed contacts side of the terminal bolts abut against locking parts of the feet of the terminal bolts, the positions of the terminal bolts relative to the tubular members are regulated and pressing forceaxial pressing forces on the tightening members can be absorbed by the locking parts. Since spaces are created between the terminal holes and the terminal bolts at places being closer to the contact chamber side than the locking part side of the terminal bolts, the airtightness of the contact chamber can be secured by interposing the sealing members in the spaces in elastically compressed states. Moreover, even if the sealing members with large thickness are used for the improvement of the airtightness of the contact chamber, the contact cover does not expanded in the radial direction in the range in which the cross-section of the tubular members after elastic compression falls within the projected plane in the axial direction of the sealing members.

It is preferable that the fixed contact may be serration-fitted to a knurled part formed to the contact chamber side rather than the sealing member of the terminal bolt.

According to this configuration, since the airtightness of the contact chamber is secured by arranging the sealing members at the opposite side to the knurled parts, crevices between fixed contacts and the knurled parts does not have a bad influence on the airtightness of the contact chamber.

It is preferable that the tubular member has a notch part formed on the inner surface of the contact chamber.

According to this configuration, the stress by the pressing force of the tightening members can be distributed in the axial direction and the radial direction, the tubular members can be engaged with the locking parts more reliably.

It is preferable that the locking part is provided separately from the terminal bolt.

According to this configuration, a complicated forming step of forming a projection in the midway of the terminal bolts is not needed, and locking parts can be prepared by attaching locking members to the terminal bolts, and so manufacture of the products can be made easily. Moreover, before preparing locking members to the terminal bolts, sealing members can be fitted, whereby sealing members can be attached easily.

It is preferable that the locking member is fitted into a groove part formed at a foot of the terminal bolt.

According to this configuration, the strength of the locking member to the pressing force of the tightening member can be made high by regulating the position in axial direction of the locking member relative to the terminal bolt, whereby the ring terminal can be more firmly tightened to the terminal bolt.

It is preferable that a cross-section of the locking part is circular, cross section of the groove part and the notch part has a circular arc which fits to the cross-sectional shape of the locking part respectively.

According to this configuration, since the locking member and terminal bolt, the locking member and the tubular member are surface-contacted respectively, whereby stress produced among them can be distributed.

It is preferable that the locking member is a C-ring made of rounded steel wire.

According to this configuration, the C-ring can be inserted into the terminal bolt in the state where the diameter of the locking member is expanded using the elastic deformation of the C-ring. When the locking member reaches the groove part, the diameter of the locking member returns, whereby the locking member can be certainly fixed to the terminal bolt.

It is preferable that the locking part is made of piano wire.

According to this configuration, the piano wire has a high strength and is reliable. Furthermore, since the piano wire has elasticity, the piano wire has a good attachment performance, and suitable for using as locking part.

It is preferable that the tubular member is made of metal.

According to this configuration, since metal has high strength, metal can bear the large pressing force of the tightening member, and also since metal has high creep tolerance, loosening of the tightening member by age deterioration can be controlled.

It is preferable that the tubular member is provided to the contact cover by insert-molding According to this configuration, since the tubular member can be simultaneously formed at the time of forming the contact cover, the manufacturing process can be simplified.

DETAILED DESCRIPTION OF PREFERRED EMBODIMENTS

<First Embodiment>

Figure 1:
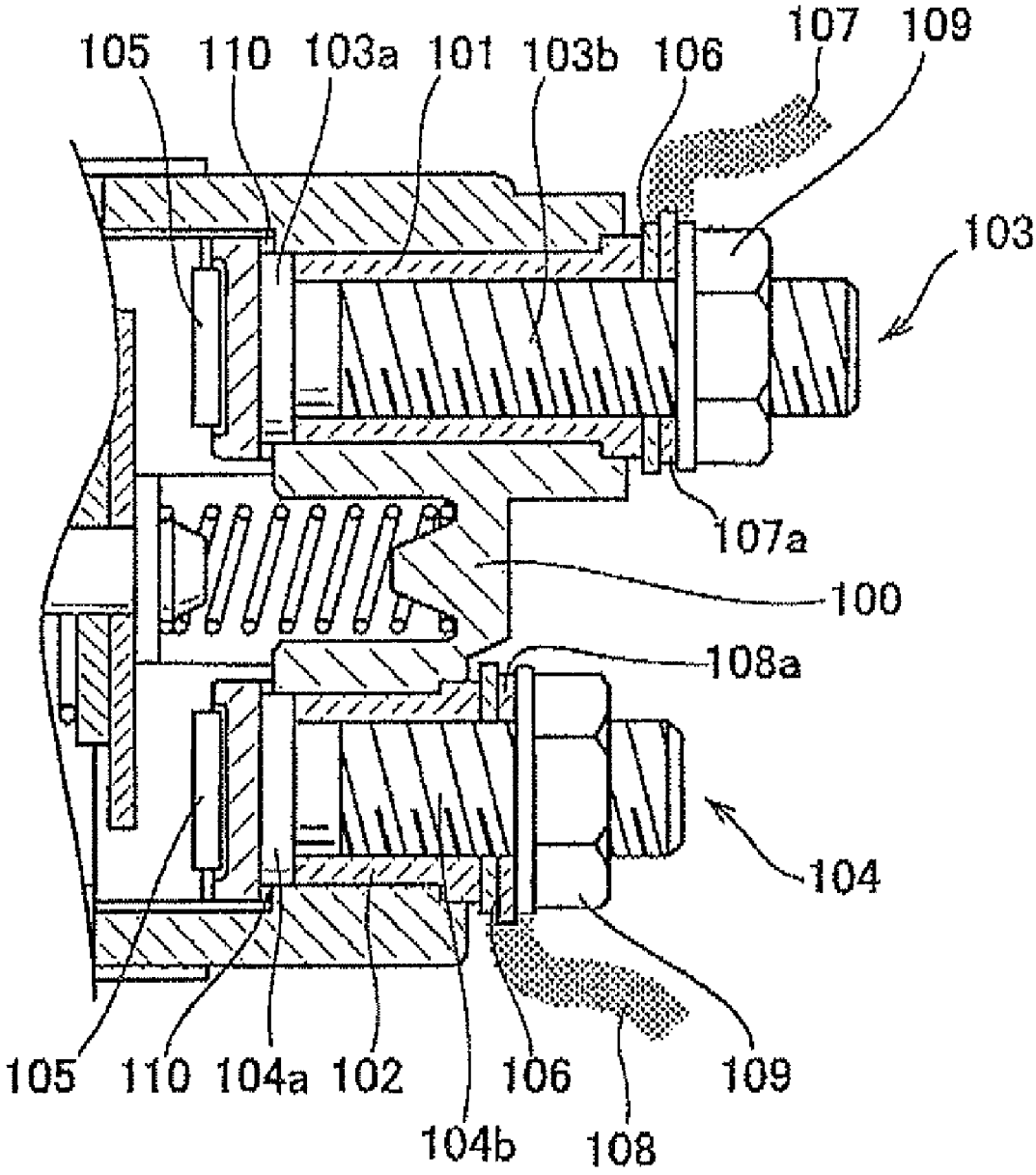
FIG. 1 PRIOR ART
FIG. 1 is a cross-sectional view of a conventional contact cover and its surroundings of an electromagnetic switch.
Figure 2:
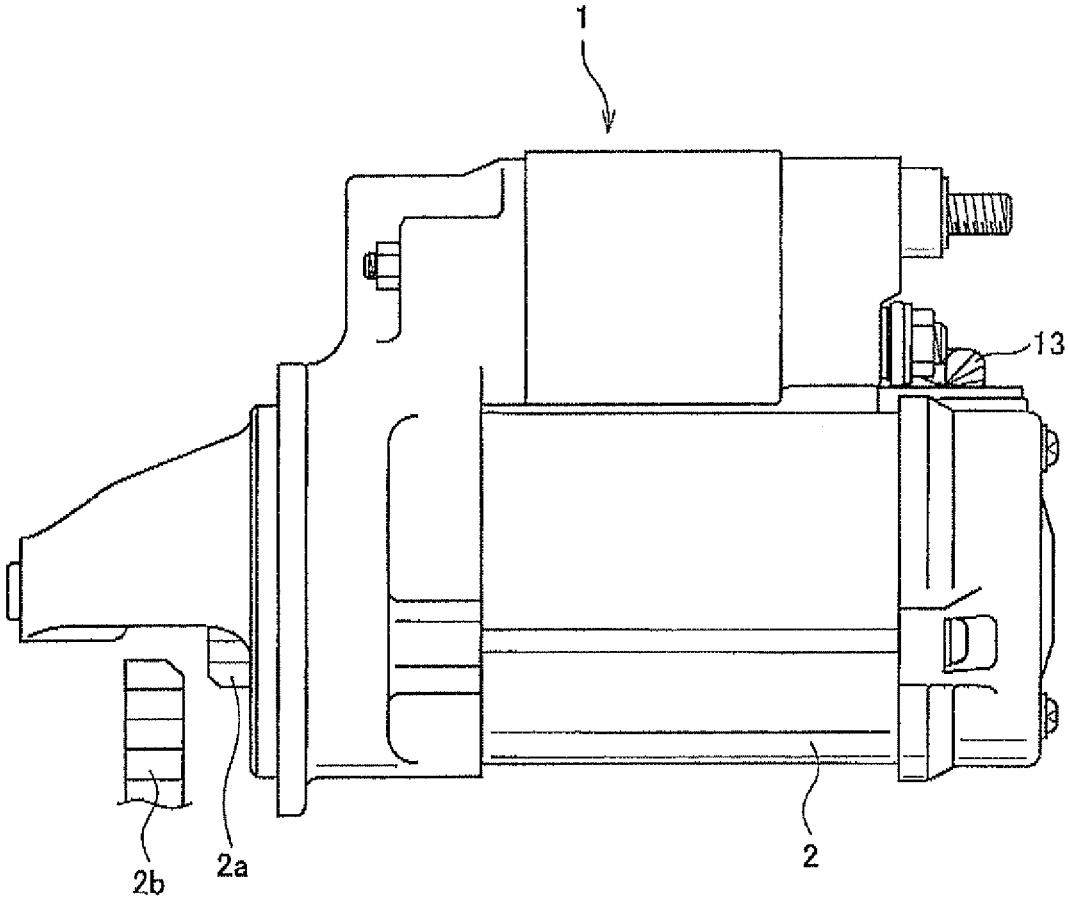
FIG. 2 is an overall view of a starter having an electromagnetic switch.
Figure 3:
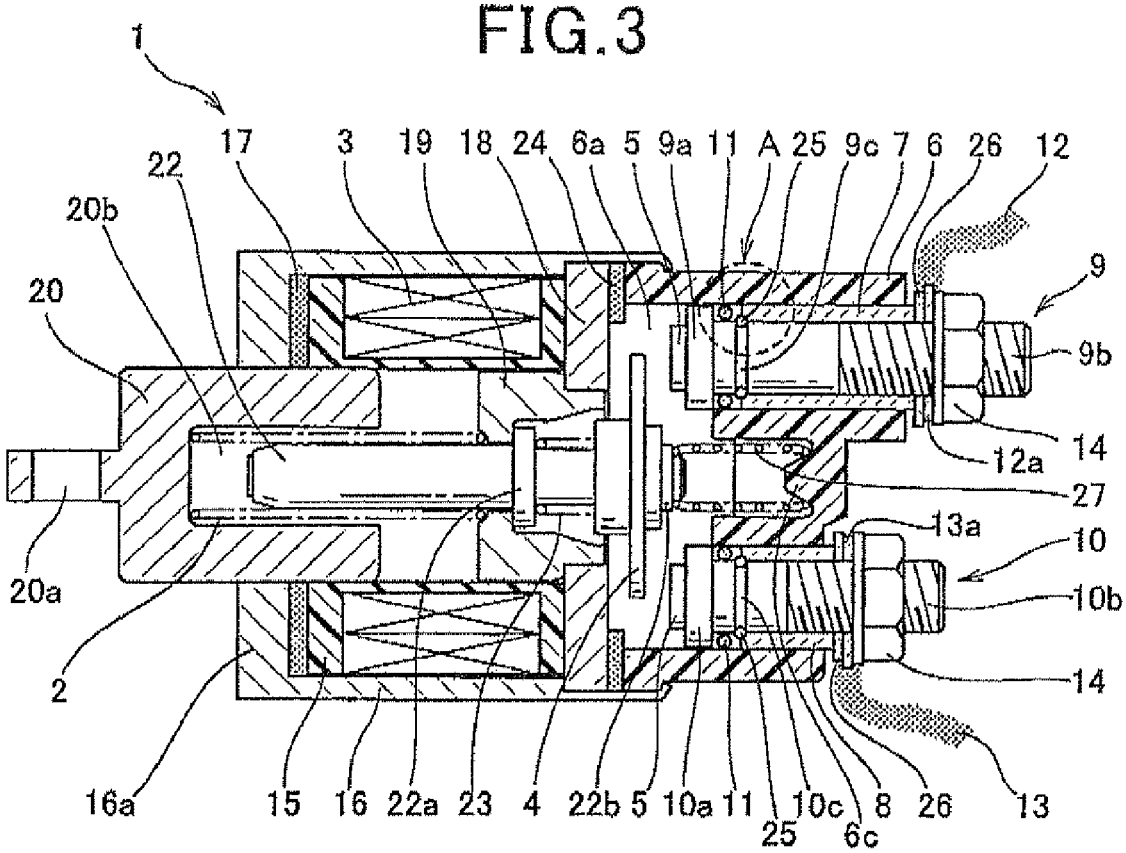
FIG. 3 is a cross-sectional view of an entire electromagnetic switch of the first embodiment.

As shown in FIG. 2, an electromagnetic switch 1 of the present embodiment is mounted in a starter, and turns on/off a conduction (energizing) current of a starter motor 2. As shown in FIG. 3, the electromagnetic switch 1 includes an exciting coil 3 which generates magnetomotive force by being energized, a movable contact 4 driven by the magnetomotive force of the exciting coil 3, a pair of fixed contacts 5, 5 placed opposite the movable contact 4, a contact cover 6 of a bottomed shape having a contact chamber 6*a* provided therein with the movable contact 4 and the pair of fixed contacts 5, 5, and collars 7, 8 fitted into respective terminal holes 6*b*, 6*b* formed in the bottom of the contact cover 6. The electromagnetic switch 1 further includes terminal bolts 9, 10 inserted in respective hollow parts of the collars 7, 8 and electrically conducting with the pair of fixed contacts 5 respectively, O-rings 11, 11 sealing respective gaps between the terminal holes 6*b*, 6*b* and the terminal bolts 9, 10, and nuts 14, 14 screwed on the respective male screws of the terminal bolts 9, 10, so as to fix ring terminals 12*a*, 13*a* to the terminal bolts 9, 10 respectively. Here, the collars 7, 8 constitute tubular members of the present invention, the O-ring constitutes a sealing member, and the nut 14 constitutes a tightening member.

As shown in FIG. 3, the exciting coil 3 is a two-layer coil wound around a cylindrical bobbin 15 having flanges formed at its both ends. The bobbin 15 is accommodated in a cylindrical yoke 16, and is abutted through a buffer member 17 against a bottom wall part 16*a* formed on one end of the yoke 16. Moreover, the magnetic plate 18 having a hole at its center is disposed to an opening on the other end of the yoke 16, and is abutted against an end surface of the bobbin 15. By ON operation of an ignition key, the exciting coil 3 is energized and generates magnetic flux, and together with the yoke 16 and the magnetic plate 18, forms a magnetic circuit.

As shown in FIG. 3, a fixed iron core 19, whose one end is press-fitted into the hole of the magnetic plate 18, is fixed to a hollow part of the bobbin 15 having an insertion hole at its center, and a movable iron core 20 placed opposite the other end of the fixed core 19 is slidably inserted into the hollow part of the bobbin 15. A concave part is formed in an opposing surface of the movable iron core 20 to the fixed iron core 19. A drive spring 21 is interposed between a bottom of the concave part of the movable iron core 20 and an opposing surface of the fixed iron core 19 to the movable iron core 20, whereby the movable iron core 20 is energized toward the opposite side from the fixed iron core 19 side. Moreover, a connector 20*a* of a gearshift (not shown in FIG. 3) is formed on a surface opposite the facing side of the movable iron core 20 to the fixed iron core 19. The gearshift drives a pinion gear 2*a* of a starter so as to be extruded toward a ring gear 2*b* side.

As shown in FIG. 3, a rod 22 is guided into an insertion hole of the fixed iron core 19, and one end of the rod 22 extends toward the concave part 20*b* of the movable iron core 20. The movable contact 4 is made of a material having excellent electrical conductivity, and is arranged at the other end of the rod 22 slidably along the rod 22. Moreover, by a contact pressure spring 23 interposed between the movable contact 4 and a large diameter part 22*a* disposed halfway of the rod 22, the movable contact 4 is energized toward a stopper 22*b* provided at the tip of the rod 22.

The fixed contact 5 is made of a material having excellent electrical conductivity, and consists of a pair of a contact point electrically conducted with a battery and a contact point electrically conducted with a motor. As shown in FIG. 3, at the bottom of the contact cover 6, a pair of the fixed contacts 5 is placed opposite the movable contact 4 in a manner of freely contacting with and separating from the movable contact 4.

The contact cover 6 is made of a insulating material having high heat resistance, such as phenol resin, is formed in an approximately bottomed cylindrical shape as shown in FIG. 3, and has the contact chamber 6*a* accommodating therein the movable contact 4 and the pair affixed contacts 5, 5. Moreover, by a return spring 27 interposed between a convex part 6*c* at the center of the bottom of the contact cover 6 and an end on a side facing the movable contact 4 of the rod 22, the rod 22 is energized toward the opposite side from the fixed contact 5 side. An opening side of the contact cover 6 is inserted in an opening of the yoke 16, an end of perimeter is swaged and fixed to the yoke 16. Here, the opening end of the contact cover 6 is abutted against the magnetic plate 18 through a packing 24 made of resin in order to secure the airtightness of the contact chamber 6*a*.

Figure 4:
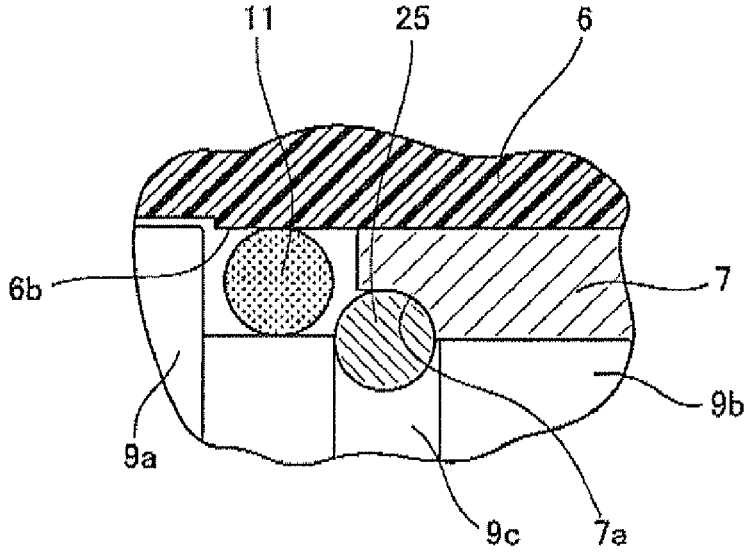
FIG. 4 is a magnified view of a substantial part A of FIG. 3 illustrating an engaging state of notch part of a collar and a C ring.

The collar 7 (8) is made of metal such as iron, and as shown in FIG. 4, it is fitted into terminal hole 6*b* formed in the bottom of the contact cover 6 for the battery terminal (the motor terminal), for example, by insert-molding. One end part at the contact chamber 6*a* side of the collar 7 (8) is disposed at somewhat inner part than an open end of terminal hole 6*b* whereby a space is formed in the projected plane in the axial direction of the collar 7 (8). Moreover, circular notch part 7*a* (8*a*) is formed at the inner diameter end part by the side of the contact chamber 6*a* of collar 7 (8).

As shown in FIG. 3, the terminal bolt 9 (10) is bolt-like member having a head 9*a* (10*a*) whose diameter is larger than a shaft diameter and a foot 9*b* (10*b*) in a part of which a male screw is formed. The terminal bolt 9 (10) is made of metal material of high strength such as steel. The terminal bolt 9 is a battery terminal bolt 9 conducted with a battery (not shown), and the terminal bolt 10 is a motor terminal bolt 10 conducted with a motor 2. A pair of fixed contacts 5, 5 is blazed to heads 9*a*, 10*a* respectively. Moreover, as shown in FIG. 4, a U-shaped groove 9*c* (10*c*) (the groove part of the present invention) is circumferentially formed at the midway of the foot 9*b* (10*b*) where the male screw is not formed. A locking part projected in the direction of an outer diameter is configured by fitting a C-ring 25 (the locking member of the present invention) into the U-shaped groove 9*c* (10*c*). The C-ring 25 is formed by rolling up for example a piano wire with approximately circular cross-section The foot 9*a* (10*a*) of the terminal bolt 9 (10) is inserted into a hollow part of the collar 7 (8) from the inside of the contact cover 6 toward the outside, and the foot 9*a* (10*a*) of the terminal bolt 9 (10) is engaged with the notch part of the collar 7 (8), then the position of the terminal bolt 9 (10) is regulated. In addition, the curvature of the cross-section of the C-ring 25 is almost the same as the curvature of the circle part of the U-shaped groove 9*c* (10*c*) and the circle part of notch part 7*a* (8*a*). The C-ring 25 is plane-contacted to the U-shaped groove 9*c* (10*c*) and notch part 7*a* (8*a*).

O-ring 11 is made of resin having elasticity, and as shown in FIG. 4, the O-ring 11 is locked at the midway of the terminal bolt 9 (10) and is closer to the head 9*a* (10*a*) side than the C-ring 25 is. The thickness of the O-ring 11 before assembled is slightly larger than the thickness of the collar 7 (8). After the O-ring 11 is assembled, it is elastically compressed between the terminal hole 6*b* and the terminal bolt 9 (10) whereby this space is sealed and the airtightness of the contact chamber 6*a* is secured.

As shown in FIG. 3, the nut 14 is screwed on the male screw of the terminal bolt 9 (10), and fastens and fixes the ring terminal 12*a* (13*a*) formed at the tip of a battery cable 12 (a motor lead 13) between the nut 14 and a fixed washer 26 which abuts against the end of collar 7 (8). The pressing force caused by fastening the nut 14 received by the C-ring 25 of the terminal bolt 9 (10) through the collar 7 (8).

Next, operation of the electromagnetic switch 1 is explained.

The exciting coil 3 is energized by ON operation of an ignition switch and generates magnetomotive force, and then the fixed iron core 19 and the movable iron core 20 are magnetized. While the movable contact 4 presses and contracts the return spring 27 through the rod 22, the movable contact approaches the fixed contact 5 side, at the same time movable iron core 20 is attracted toward the fixed iron core 19 side. When the movable contact 4 abuts against the fixed contact 5, the movable contact 4 separates from stopper 22*b* and pressurizes contact pressure by pressing and contracting the contact pressure spring 23. And the movable contact 4 short-circuits between the battery terminal bolt 9 and the motor terminal bolt 10 by making the pair of fixed contacts 5 conduct and the motor 2 operates in response to electric supply of a battery and generates torque. On the other hand, when the movable iron core 20 is attracted toward the fixed iron core 19 side, the pinion gear 2*a* is pushed out to the ring gear 2*b* side of the engine, the torque of the motor 2 is transmitted, and the engine is started since the connector 20*a* of the movable iron core 20 drives the gearshift (not shown).

After the engine starting, energization of the exciting coil 3 is stopped and the attraction force between the fixed iron core 19 and the movable iron core 20 disappears by OFF operation of the ignition switch. Thus the rod 22 is put back by the reaction force of the return spring 27 and the movable contact 4 is separated from the fixed contact 5 whereby the operation of the motor 2 is suspended.

<Effect of First Embodiment>

Since an end on the contact chamber 6*a* side of the collar 7 (8) abuts against the C-ring 25 of the foot 9*a* (10*a*) of the terminal bolt 9 (10), the position of the terminal bolt 9 (10) relative to the collar 7 (8) is regulated and the pressing force in the axial direction of the nut 14 can be received by the locking part. Accordingly, a space is created between the terminal hole 6*b* and the terminal bolt 9 (10) at a place being closer to the contact chamber 6*a* side than the C ring 25 side of the terminal bolt 9 (10) is. The airtightness of the contact chamber 6*a* can be secured by interposing the O-ring 11 in the space in an elastically compressed state. Even if the O-ring 11 with large thickness is used for the improvement of the airtightness of the contact chamber 6*a*, the contact cover 6 is not expanded in the radial direction in the range in which the cross-section of the O-ring 11 after elastic compression falls within the projected plane in the axial direction of the collar 7 (8).

Since the stress by the pressing force of the nut 14 can be distributed in the axial direction and the radial direction by forming the notch part 7*a* (8*a*) which is engaged with the C-ring 25 on the inner surface of the collar 7 (8), so engagement of the collar 7 (8) and the C-ring 25 can be made more reliable.

The complicated forming step of forming a projection in the midway of the terminal bolt 9 (10) is not needed when the C-ring 25 is used in the locking part. The locking part can be prepared by attaching the C-ring 25 to the terminal bolt 9 (10) whereby products can be manufactured easy. Moreover, since the O-ring 11 can be fitted before preparing the C-ring 25 to the terminal bolt 9 (10), the O-ring 11 can be attached easily.

The position in the axial direction of the C-ring 25 relative to the terminal bolt 9 (10) can be regulated by forming the U-shaped groove 9*c* (10*c*) in which the C-ring 25 is fitted into the terminal bolt 9 (10). Thereby, strength against the pressing force of the nut 14 can be made high, and the ring terminal 12*a* (13*a*) can be more firmly tightened to the terminal bolt 9 (10).

Since the cross-section of both the U-shaped groove 9*c* (10*c*) and the notch part has a circular arc which fits to the cross-sectional shape of the C-ring 25 respectively, the C-ring 25 and the terminal bolt 9 (10), the C-ring 25 and collar 7 (8) are surface-contacted respectively, whereby stress produced among them can be distributed.

Since the C-ring 25 is a rounded steel wire, the C-ring can be inserted into the terminal bolt 9 (10) in the state where the diameter of the C-ring 25 is expanded using the elastic deformation of the C-ring 25. When the locking part reaches the groove part, the diameter of the C-ring 25 returns, whereby the C-ring 25 can be certainly fixed to the terminal bolt 9 (10).

If a piano wire is used for the C-ring 25, since the piano wire has a high strength, reliable products can be manufactured. Furthermore, since the piano wire has elasticity, the piano wire has a good attachment performance, and suitable for using as locking part.

By making collars 7 (8) with metal, since metal has high strength, metal can bear the large the pressing force of the nut 14, and also since metal has high creep tolerance, loosening of the nut 14 by aged deterioration can be controlled. Moreover, by forming collar 7 (8) by insert-molding, since collars 7 (8) can be simultaneously formed at the time of forming the contact cover 6, a manufacturing process can be simplified.

<Second Embodiment>

Figure 5:
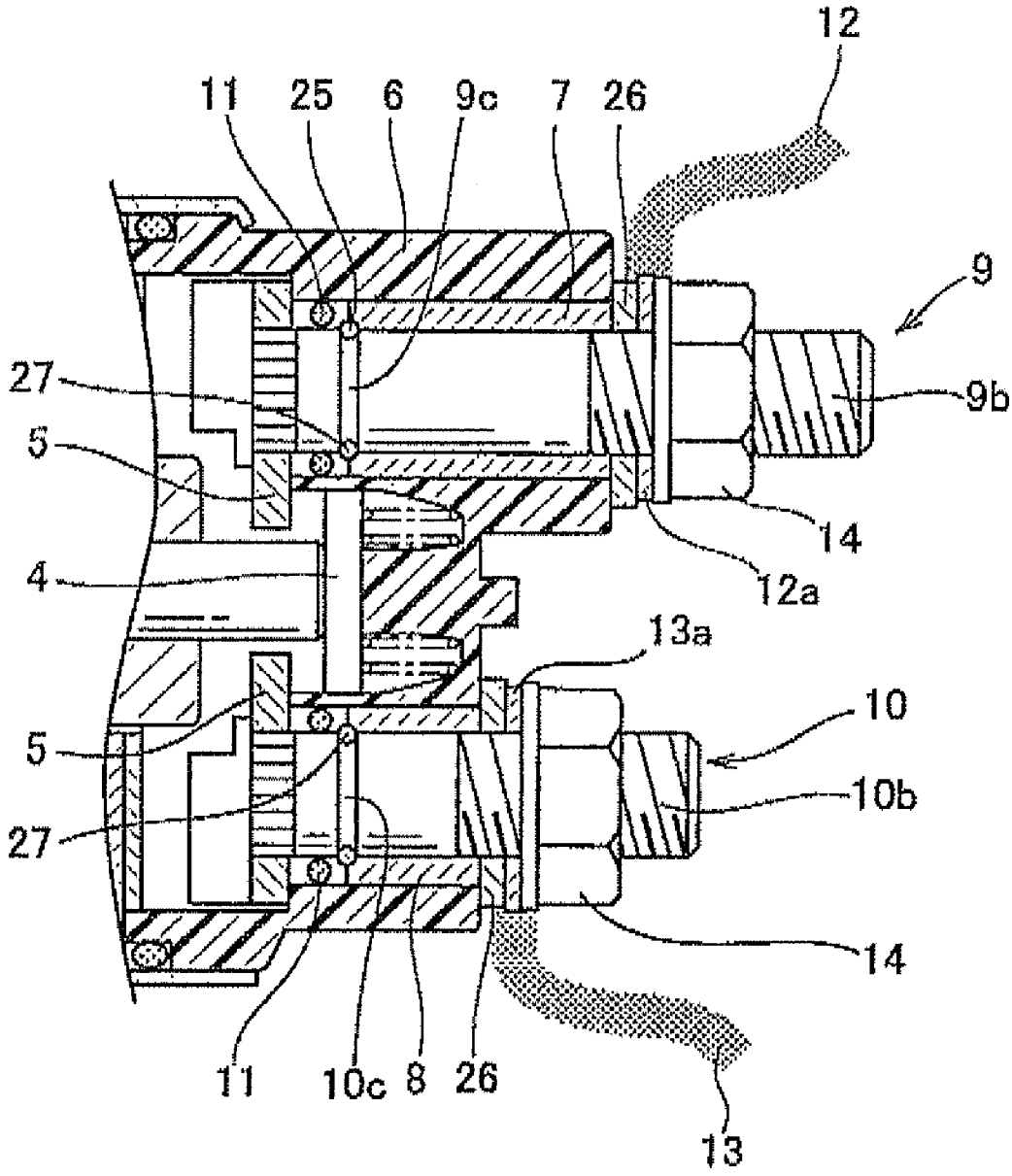
FIG. 5 is a cross-sectional view of a contact cover and its surroundings of the electromagnetic switch of the second embodiment.

In the electromagnetic switch of the first embodiment, the fixed contact 5 is brazed to the head 9*a* (10*a*) of the terminal bolt 9 (10), but in the electromagnetic switch of the second embodiment, the fixed contact 5 is serration-fitted to a knurled part 9*d* (10*d*) formed at one end at the contact chamber 6*a* side of the terminal bolt 9 (10) as shown in FIG. 5.

With such configuration, since a crevice is made to a serration-fitted part of the fixed contact 5, there is concern that airtightness of the contact chamber 6*a* may be reduced. However, by inserting the O-ring 11 in the foot 9*b* (10*b*) of the terminal bolt 9 (10), and between the knurled part 9*d* (10*d*) and the O-ring 25, a sealing member is disposed outside the knurled part 9*d* (10*d*) and the airtightness of the contact chamber 6*a* is secured, whereby the crevice between the fixed contact 5 and the knurled part 9*d* (10*d*) does not have a bad influence on the airtightness of the contact chamber 6*a*.

Other configuration and an effect are the same as that of the first embodiment.

<Modification>

The collar 7 (8) may be provided loosely fitted in the contact cover 6, or pressed into the contact cover 6.

What is claimed is:

1. An electromagnetic switch including:

an exciting coil which generates magnetomotive force by being energized;

a movable contact driven by the magnetomotive force of the exciting coil;

a pair of fixed contacts placed opposite of the movable contact;

a contact cover of a bottomed shape having a contact chamber provided therein, and containing the movable contact and the pair of fixed contacts;

tubular members fitted into respective terminal holes formed in the bottom of the contact cover;

terminal bolts inserted in respective tubular members and conducted with the pair of fixed contacts respectively;

sealing members sealing respective gaps between the terminal holes and the terminal bolts; and tightening members screwed on respective male screws of the terminal bolts, so as to fix ring terminals to the terminal bolts respectively, wherein:

the terminal bolts have locking parts projected in the direction of their outer diameter, one end at the contact chamber side of the tubular members abut against the locking parts, the sealing members are engaged closer to the contact chamber side than the locking parts of the terminal bolts are, and a locking member is provided separately from the terminal bolt.

2. The electromagnetic switch according to claim 1, wherein the fixed contact is serration-fitted to a knurled part formed to the contact chamber side rather than the sealing member of the terminal bolt.

3. The electromagnetic switch according to claim 1, wherein the tubular member has a notch part formed on the inner surface of the contact chamber.

4. The electromagnetic switch according to claim 1, wherein the locking member is fitted into a groove part formed at a foot of the terminal bolt.

5. The electromagnetic switch according to claim 1, wherein a cross-section of the locking member is circular, cross-section of a groove part and a notch part has a circular arc which fits to a cross-sectional shape of the locking part respectively.

6. The electromagnetic switch according to claim 1, wherein the locking member is a C-ring made of rounded steel wire.

7. The electromagnetic switch according to claim 1, wherein the locking member is made of piano wire.

8. The electromagnetic switch according to claim 1, wherein the tubular member is made of metal.

9. The electromagnetic switch according to claim 1, wherein the tubular member is provided to the contact cover by insert-molding.

10. An electromagnetic switch including:

an exciting coil which generates magnetomotive force by being energized;

a movable contact driven by the magnetomotive force of the exciting coil;

a pair of fixed contacts placed opposite of the movable contact;

a contact cover of a bottomed shape having a contact chamber provided therein, and containing the movable contact and the pair of fixed contacts;

tubular members fitted into respective terminal holes formed in the bottom of the contact cover;

terminal bolts inserted in respective tubular members, conducted with the pair of fixed contacts respectively, and having respective feet at which respective male screws are formed;

sealing members sealing respective gaps between the terminal holes and the terminal bolts, and tightening members screwed on the respective male screws of the terminal bolts, so as to fix ring terminals to the terminal bolts respectively, wherein:

the terminal bolts have locking parts projected in the direction of their outer diameter, one end at the contact chamber side of the tubular members abut against the locking parts, the sealing members are engaged closer to the contact chamber side than the locking parts of the terminal bolts are, the terminal bolt has a knurled part formed at an outer periphery of the terminal bolt, the knurled part being disposed closer to the contact chamber rather than the sealing member, the fixed contact is serration-fitted to the knurled part, being attached to the outer periphery of the terminal bolt, and the fixed contact has a through-hole, and the terminal bolt is disposed inside of the through-hole.

* * * * *